US007415791B2

(12) United States Patent
Williams, III et al.

(10) Patent No.: US 7,415,791 B2
(45) Date of Patent: Aug. 26, 2008

(54) RIFLE SCOPE WITH ADJUSTMENT KNOB HAVING MULTIPLE DETENT FORCES

(75) Inventors: John B Williams, III, Fullerton, CA (US); Nick A Baroldi, Yorba Linda, CA (US)

(73) Assignee: U.S. Optics, Inc., Buena Park, CA (US)

( * ) Notice: Subject to any disclaimer, the term of this patent is extended or adjusted under 35 U.S.C. 154(b) by 0 days.

(21) Appl. No.: 11/399,849

(22) Filed: Apr. 8, 2006

(65) Prior Publication Data

US 2007/0137089 A1 Jun. 21, 2007

Related U.S. Application Data

(60) Provisional application No. 60/597,849, filed on Dec. 21, 2005.

(51) Int. Cl.
*F41G 1/18* (2006.01)

(52) U.S. Cl. ..... 42/122; 42/119; 89/41.17; 359/429

(58) Field of Classification Search ..... 42/122, 42/123, 130, 119, 129; 359/400, 429; 89/41.17
See application file for complete search history.

(56) References Cited

U.S. PATENT DOCUMENTS 4,247,161 A * 1/1981 Unertl, Jr. ..... 359/424
6,519,890 B1 * 2/2003 Otteman ..... 42/122
6,691,447 B1 * 2/2004 Otteman ..... 42/122

* cited by examiner

*Primary Examiner*—Michael J. Carone
*Assistant Examiner*—Benjamin P Lee
(74) *Attorney, Agent, or Firm*—Bennet K. Langlotz; Langlotz Patent Works, Inc.

(57) ABSTRACT

A rifle scope has a body with a number of optical elements. An adjustment knob is rotated we connected to the body and interacts with at least one of the optical elements to provide an image shift in response to rotation of the knob. A detent mechanism interacts with the knob, and has a number of detent positions. Many of the detent positions have a first detent force, and a selected subset the detent positions have a greater second force. The selected subset of detent positions may correspond to selected major distance intervals.

2 Claims, 4 Drawing Sheets

RIFLE SCOPE WITH ADJUSTMENT KNOB HAVING MULTIPLE DETENT FORCES

REFERENCE TOP RELATED APPLICATION

This application relates to Provisional Application for Patent Ser. No. 60/597,849, filed Dec. 21, 2005, entitled "Dual Detent Elevation Knob for Use on Riflescopes."

FIELD OF THE INVENTION

This invention relates to rifle scopes, and more particularly to adjustment knobs for rifle scopes.

BACKGROUND AND SUMMARY OF THE INVENTION

Rifle scopes are provided with crosshairs or other reticle designs to provide an indication of an aiming point, where a bullet is expected to impact. Because bullets follow the path of an arc, the point of impact varies based on distance. Therefore, rifle scopes are normally equipped with adjustment knobs to shift optical components within the rifle scope to compensate for bullet drop. If a target distance is known, a knob adjustment is made based upon the predicted trajectory of the bullet. For a given type of ammunition, and elevation adjustment knob may be marked with distance markings to indicate to the shooter the proper setting for targeted a given distance. This is referred to as a "bullet drop compensator" (BDC).

A rifle scope elevation knob will typically have a detent mechanism that provides the shooter with tactile feedback of the number of "clicks" by which the knob has been rotated. Each click is a selected incremental angle of adjustment, and the clicks are all of the same value. Without a bullet drop compensator, a shooter must memorize or carry information indicating the number of clicks of adjustment required for a given distance.

Even with a bullet drop compensator, in dark conditions the shooter must rely on the tactile perception of the number of clicks, because bullet drop compensator markings may not be visible.

An adjustment knob with more clicks per degree or minute of angle will provide finer control, which is especially useful at greater distances. A coarser detent arrangement will provide less precision, but makes it easier for the shooter to count the number of clicks. For a distant target requiring a substantial adjustment to compensate for significant bullet drop, the shooter may be required to accurately count dozens of clicks. This slows the adjustment process, and is prone to errors that can be critical. Such errors can accumulate as the shooter makes further adjustments, such as to engage different targets, or to fine tune shot placement based on initial results.

The present invention overcomes the limitations of the prior art by providing a rifle scope having a body with a number of optical elements. An adjustment knob is rotatably connected to the body and interacts with at least one of the optical elements to provide an image shift in response to rotation of the knob. A detent mechanism interacts with the knob, and has a number of detent positions. Many of the detent positions have a first detent force, and a selected subset the detent positions have a greater second force. The selected subset of detent positions may correspond to selected major distance intervals.

DETAILED DESCRIPTION OF A PREFERRED EMBODIMENT

Figure 1:
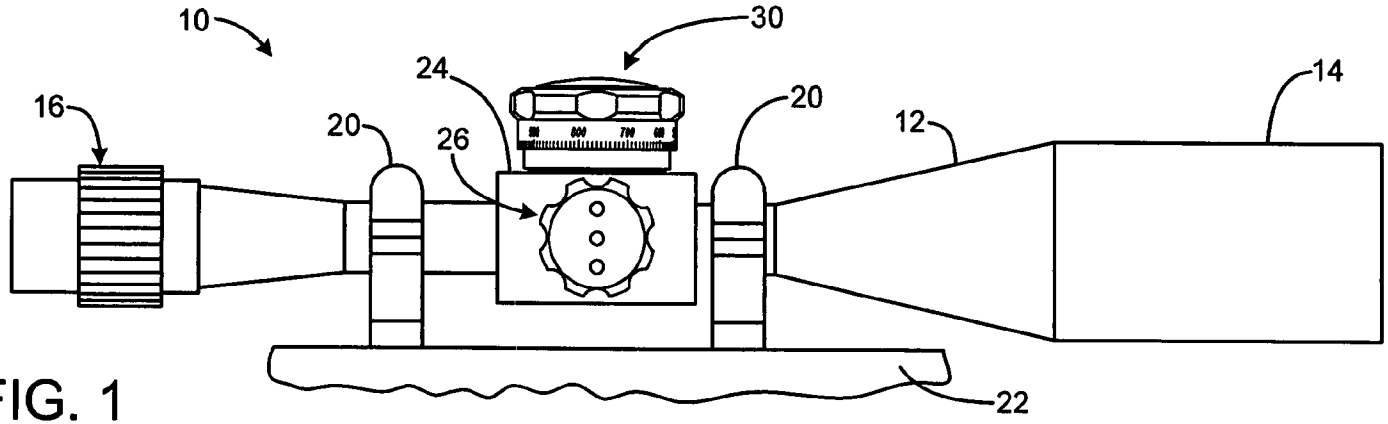
FIG. 1 is a side view of a rifle scope according to a preferred embodiment of the invention.

FIG. 1 shows a rifle telescope 10 having a tubular body 12 with a forward objective lens 14, and an eyepiece 16 at the opposite end. The telescope 10 is mounted by rings 20 to the frame 22 of a rifle. A central housing 24 is located at an intermediate position on the body, and supports a windage knob 26 and an elevation knob 30. An optical element such as a prism or lens assembly (not shown) is located within a bore defined by the body, and is shifted in position in response to rotation of the knobs, to adjust the aiming point of the reticle. This allows the user to zero the scope, to compensate for wind drift, and to compensate for bullet drop over distance.

Figure 2:
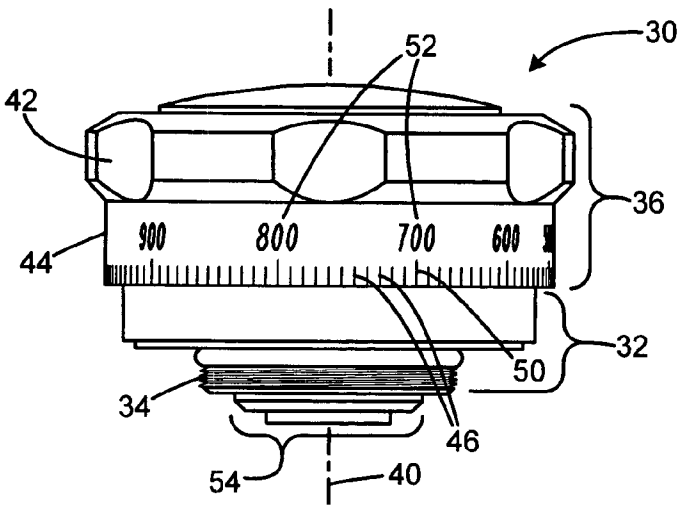
FIG. 2 is a side view of an elevation adjustment knob according to the embodiment of FIG. 1.

FIG. 2 shows the elevation knob 30 in greater detail. A body portion 32 is fixed to the housing 24 when assembled, by way of threads 34 that engage a threaded bore in the housing. A rotatable knob 36 rotates with respect to the housing about a vertical axis 40. The knob has a grip portion 42 that is knurled or textured, or provided with a readily gripped shape as shown. A skirt portion 44 of the knob has a cylindrical exterior that is marked with a set of evenly spaced lines 46. A minority of the lines are extended lines 50, with which are associated alphanumeric distance indicators 52 that indicate milestone distances such as intervals of 100 years or 100 meters. Typically, there are about 5-12 lines 46 between each adjacent pair of milestone lines. Each line may indicate an angular increment of 1/10 minute of angle (MOA) 1/4 MOA, 1/2 MOA, 1 MOA, or any of a wide range of alternatives.

A plunger or main screw 54 moves axially in response to rotation of the knob about the axis with respect to the body portion. The plunger motion is directly proportionate to the knob rotation angle, so that rotating the knob by the angle defined by an adjacent lines 46, also known as a "click", will generate a consistent axial displacement by the plunger. Such a displacement shifts the internal optical element to generate an incremental shift of the rifle telescope's image, with respect to a reference point on the reticle. This incremental shift also corresponds to a consistent incremental angular shift in the image.

For bullet drop compensation, the extended lines 50, and their associated distance indicators 52 are spaced apart from each other by varying numbers of clicks. This is because the angular amount by which a bullet drops varies based on distance, with more drop occurring at greater distances. Typically, the indicated distances are in hundreds of yards, or hundreds of meters. The number of clicks between milestone distances is more numerous at greater distances.

Figure 3:
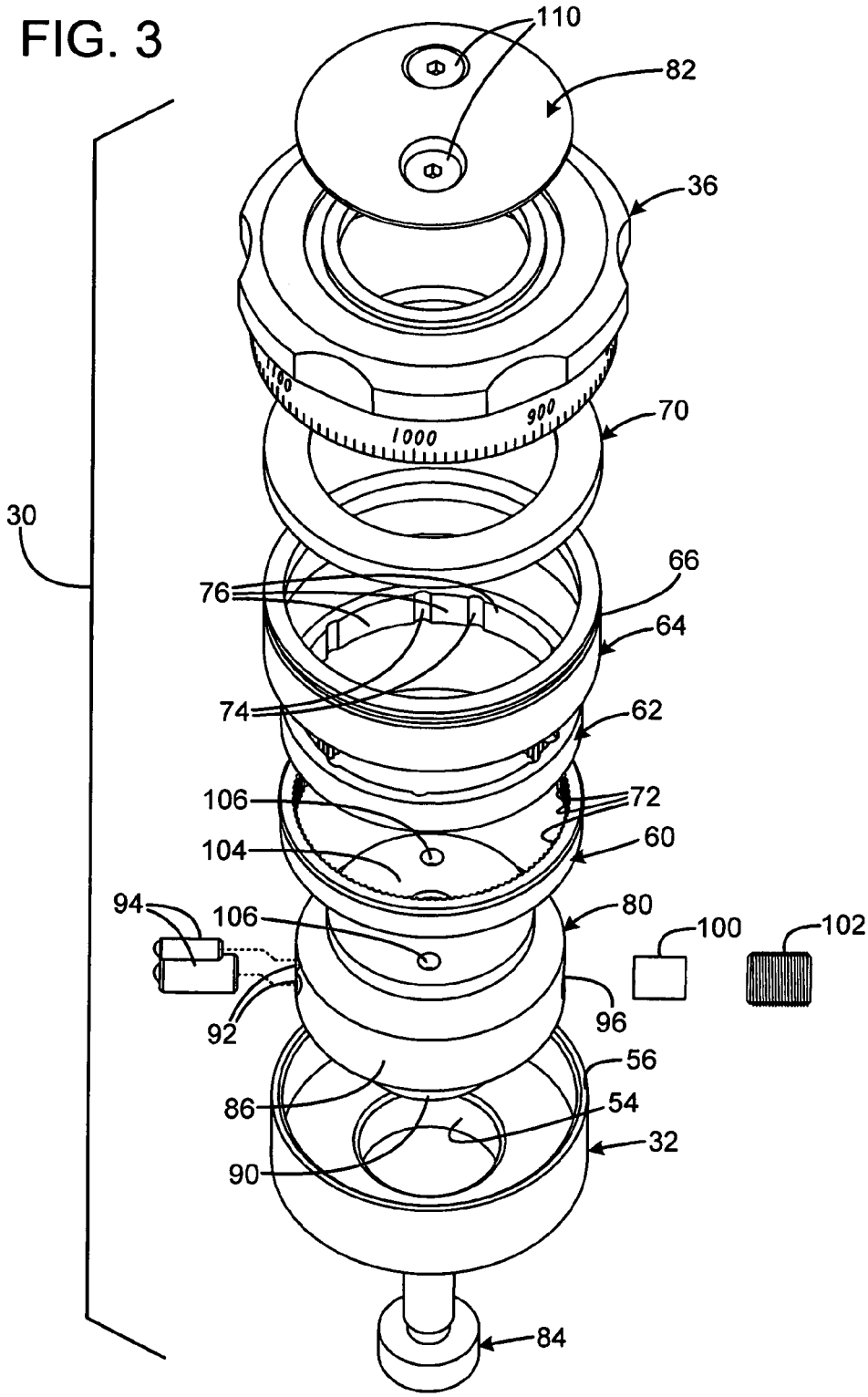
FIG. 3 is an exploded view of the embodiment of FIG. 1.

FIG. 3 shows an exploded view of the components of the knob 30. The components are divided into two subgroups. One subgroup is associated with the housing, and is fixed with respect to the rifle scope, and the second subgroup is associated with the knob, and rotates with the knob.

The housing subgroup includes the housing 32, which defines a central finely threaded bore 54, which has an upwardly extending skirt 56 that is internally threaded. An externally threaded main index ring (or "first element") 60 and an externally threaded bullet drop compensator (BDC) index ring (or "second element") 62 are received within the skirt. A spool element 64 closely surrounds the skirt, and has a circumferential annular groove 66. A stop nut 70 is a threaded ring having a downwardly extending flange that is internally threaded.

The main index ring 60 has a finely serrated internal surface with an array of evenly spaced ridges (or "minor detents" or "first detent features" or "evenly spaced elements") 72 or grooves, each oriented parallel to each other and to the axis that defines the ring. Each ridge corresponds to a click of the knob, and provides a stable resting place for a detent mechaniism to be discussed below. In the preferred embodiment, there are 90 or 110 ridges about the entire interior surface, which corresponds to the number of clicks per knob rotation. in alternative embodiments the number of ridges may be selected based on the desired application.

The BDC ring 62 has only a limited number of the internal ridges (or "major detents" or "second detent features") 74, spaced apart at carefully selected but irregular intervals, and separated by smooth surface portions 76. Each ridge 74 corresponds to a milestone distance, such as indicated by the larger lines 50 and numerals 52 marked on the knob. The BDC ridges are positioned for a specific cartridge having a known bullet drop performance. This means that the projectile from a cartridge is predictably expected to have dropped by a particular angular amount at each milestone distance. Because of the proportionality between angular image shift and knob position, the ridge locations are spaced at angular increments based on the angular amount by which a projectile will have dropped for the corresponding distance interval.

The knob subgroup includes the knob 36, a main screw 80, a knob cover 82, and a zero adjust screw 84. The main screw 80 is a cylindrical rotor having an external surface 86 that is size to be closely received within the index rings, with clearance. A finely threaded screw extension 90 is threaded to engage the finely threaded bore 54 of the housing, and provides the controlled axial shift in response to knob rotation. The rotor surface defines a pair of lateral apertures 92 that receive a corresponding pair of ball detent mechanisms 94. The detent mechanisms are installed so that spring biased balls extend slightly beyond the perimeter of the rotor surface.

The main screw defines a central threaded bore that opens to the lower and, in which receives the zero adjust screw 84. The end face of the zero adjust screw provides the bearing surface against which rests the movable optical element within the housing. The rotational position of the zero adjust screw may be adjusted to calibrate the mechanism, typically at the time of manufacturing. The rotor surface defines an additional lateral aperture 96 that receives a screw lock plug 100 and set screw 102. These are inserted to engage and secure the zero adjust screw at its factory setting.

The upper surface 104 of the main screw 80 has a pair of threaded holes 106. The knob cover 82 has a corresponding set of holes 110 that permit passage of a pair of screws to engage holes 106. Thus, the knob 36 may be captured between the main screw and the knob cover, and secured by tightening the screws. A slight loosening of the screws permits the knob to be rotated with respect to the main screw, so that the indicated distance corresponds to the actual distance, and to the milestone clicks provided by the BDC index ring.

O-rings and seals are provided throughout at all moving or removable interfaces, to provide an environmental seal for the components within the knob assembly.

Figure 4:
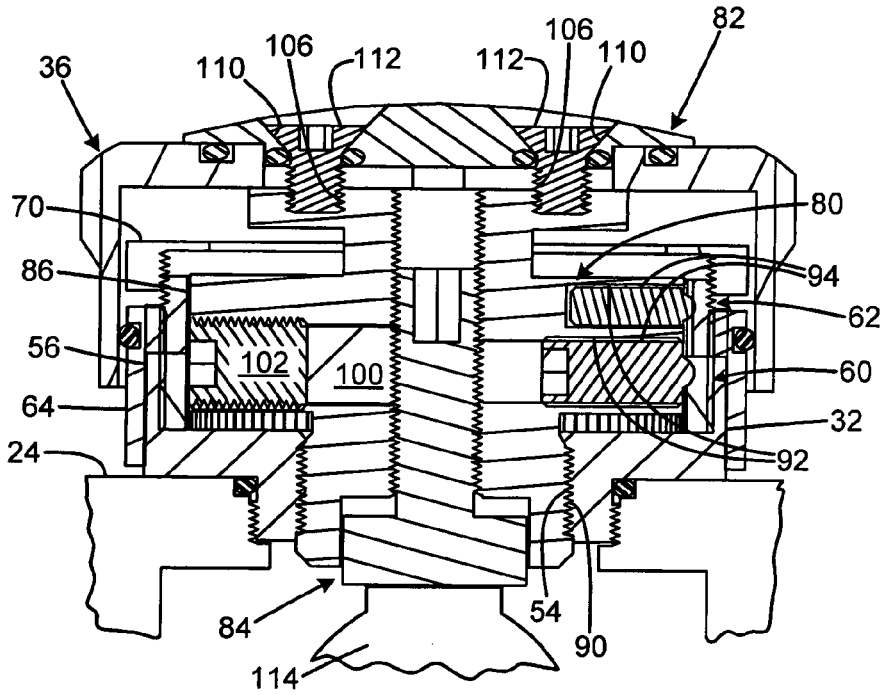
FIG. 4 is an enlarged sectional side view of the embodiment of FIG. 1.
Figure 5:
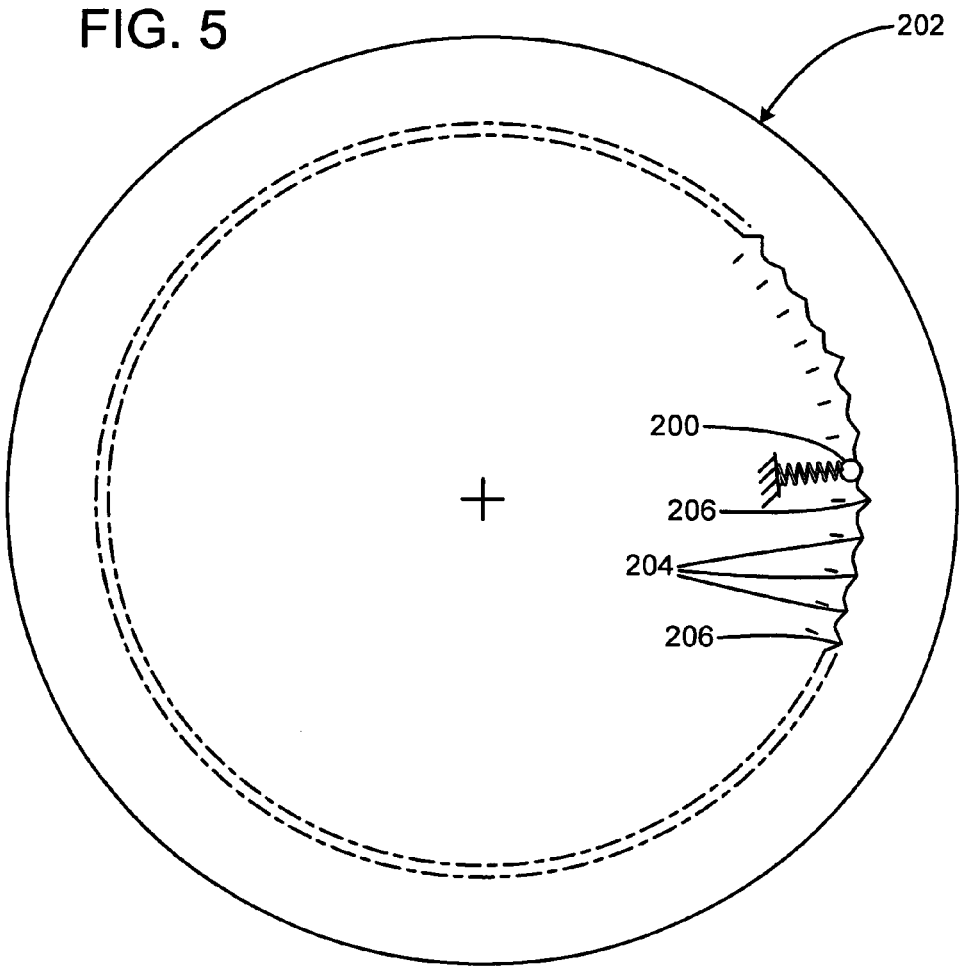

FIG. 4 is a cross-sectional view of the assembled knob. The knob assembly is shown with the zero adjust screw 84 installed and secured by screw lock plug 100 and set screw 102. the ball detent elements 94 are protruding outwardly into respective grooves in rings 60 and 62. The knob 36 is secured to the screw element 80 by screws 112, which capture the knob between the knob cover 82 and the main screw.

The lower portion 90 of the housing 32 is threadably secured to the housing 24, and the bore 54 receives the main screw's threaded portion 90. The spool 64 is threadably secured to the outside of the housing skirt 56. The main index ring 60 is threaded into the skirt, as is the BDC index ring 62. The lock nut 70 is threaded on to the exterior of the BDC ring 62. The lock nut serves to prevent removal of screw 80, and to limit it to one revolution.

An erector tube 114 is shown in contact with the zero adjust screw face 84. A spring mechanism in the housing biases the tube upward (in a diagonal direction to provide biasing toward the windage knob).

The dual detent mechanism provides tactile feedback to the user when a milestone distance (e.g. 100 yards, 200 yards . . . ) is reached. For normal clicks, only the splines or grooves on the first index ring 60 are engaged. These provide a consistent detent resistance or torque required to depress the detent ball, and to turn the knob by one or more clicks. For most clicks, a smooth portion 76 of the BDC ring is contacted by the corresponding detent ball. That contributes essentially no torque or resistance. However, when a milestone distance is reached, the detent ball engages a milestone groove 74, and provides additional torque or resistance to dislodging from that groove 74. Thus, the force or torque required to dislodge from, or pass through a milestone click is based on the sum of the effects of two detent balls. This enables the user to more readily adjust for distances in poor lighting conditions, and serves as a verification against and correction of click counting errors.

In an alternative embodiment, a single detent ball and single index ring may be employed, with the index ring having deeper or more steeply-walled grooves to correspond to the milestone distances. However, this creates manufacturing complexity, and makes it more difficult to fine tune the two different torque levels provided by the two selected detent ball mechanisms. In addition, a dual ring configuration such as shown in the preferred embodiment has the advantage that only a single removable BDC ring needs to be replaced to convert the scope to an alternative cartridge with different bullet drop characteristics.

The benefits of having two tactilely differentiable torque levels may also be employed for the windage knob. In this instance, several alternatives are possible. In one version, the ring having fewer grooves to indicate milestone positions may be provided with only a single groove, to indicate zero windage. Alternatively, the milestone ring may be selected to have a groove corresponding to every nth (e.g. $4^{th}$, $10^{th}$) fine click, for instance.

In further alternative embodiments, more than two differentiable torque levels may be provided, either by adding additional rings, or by employing different depth groups on the BDC ring (such as with the greatest force to indicate a zero adjustment position, intermediate force for other milestones, and lowest force for all other clicks).

While the above is discussed in terms of preferred and alternative embodiments, the invention is not intended to be so limited.

The invention claimed is:

1. A rifle scope comprising:

a body;

a plurality of optical elements in the body;

an adjustment knob rotatably connected to the body;

the adjustment knob being connected to at least one of the optical elements, such that an image shift is generated in proportionate response to rotation of the adjustment knob;

a detent mechanism operationally engaged to the adjustment knob;

the detent mechanism having a plurality of detent positions;

each detent position having a corresponding detent force by which the detent mechanism resists movement;

the detent force for a first plurality of the detent positions having a first value;

the detent force for a second plurality of the detent positions having a second value greater than the first value;

wherein the detent mechanism includes a first surface portion having a first plurality of similar evenly spaced ridges for engagement by a first spring biased contact element; and wherein the detent mechanism includes a second surface portion having a second plurality of ridges for engagement by a second spring biased contact element, and wherein there are fewer second elements than first elements.

2. The rifle scope of claim 1 wherein each of the evenly spaced elements of the second element corresponds to one of the second plurality of detent positions.

* * * * *